US010694863B2

(12) United States Patent
Lewis et al.

(10) Patent No.: US 10,694,863 B2
(45) **Date of Patent: *Jun. 30, 2020**

(54) UPHOLSTERED FURNITURE PIECE HAVING UPHOLSTERED ARM PANELS

(71) Applicant: Ashley Furniture Industries, Inc., Arcadia, WI (US)

(72) Inventors: James Allen Lewis, Pontotoc, MS (US); Philip Lee Stokes, Ecru, MS (US); James Anthony Sudduth, Thaxton, MS (US); Jimmy Dale Holley, Ecru, MS (US)

(73) Assignee: Ashley Furniture Industries, Inc., Arcadia, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/181,928

(22) Filed: Nov. 6, 2018

(65) Prior Publication Data

US 2019/0133335 A1 May 9, 2019

Related U.S. Application Data

(63) Continuation of application No. 15/299,316, filed on Oct. 20, 2016, now Pat. No. 10,117,521.

(Continued)

(51) Int. Cl.

*A47C 7/02* (2006.01)
*A47C 7/16* (2006.01)

(Continued)

(52) U.S. Cl.

CPC ..... *A47C 31/02* (2013.01); *A47C 7/54* (2013.01); *A47C 17/02* (2013.01); *A47C 17/86* (2013.01); *B68G 7/05* (2013.01)

(58) Field of Classification Search

CPC ..... A47C 7/54; A47C 17/02; A47C 17/86; A47C 31/02; B68G 7/05

(Continued)

(56) References Cited

U.S. PATENT DOCUMENTS 1,414,824 A 5/1922 Meutsch
2,170,224 A 8/1939 Tarr (Continued)

FOREIGN PATENT DOCUMENTS

CN 103300617 A 9/2013
CN 104223840 A 12/2014
WO WO 2012/135709 10/2012

OTHER PUBLICATIONS

International Searching Authority, Notification of Transmittal of the International Search Report and the Written Opinion of the International Searching Authority for application PCT/US2016/057973, or the Declaration, dated Feb. 21, 2017.

*Primary Examiner* — Rodney B White
(74) *Attorney, Agent, or Firm* — Christensen, Fonder, Dardi & Herbert PLLC

(57) ABSTRACT

A sofa with an upholstered arm panel has an arm frame with a layered composition comprising an underlayment material layer, a fiber material layer positioned on top of and contacting the underlayment material layer, and a covering upholstery material layer positioned on top of and contacting the fiber material layer. The underlayment material layer is comprised a planar sheet of Ethylene-vinyl acetate closed cell foam. The EVA foam extends forwardly on the arm frame to create a forward extending lip. The use of EVA foam reduces the number of structural and cushioning materials, fasteners, and labor currently required in arm panel construction.

21 Claims, 6 Drawing Sheets

Related U.S. Application Data

(60) Provisional application No. 62/244,046, filed on Oct. 20, 2015.

(51) Int. Cl.

| | |
|---|---|
| ***A47C 7/18*** | (2006.01) |
| ***A47C 7/24*** | (2006.01) |
| ***A47C 31/02*** | (2006.01) |
| ***A47C 7/54*** | (2006.01) |
| ***A47C 17/02*** | (2006.01) |
| ***A47C 17/86*** | (2006.01) |
| ***B68G 7/05*** | (2006.01) |

(58) Field of Classification Search
USPC ..... 297/440.1, 440.14, 452.48
See application file for complete search history.

(56) References Cited

U.S. PATENT DOCUMENTS

| | | | | |
|---|---|---|---|---|
| 2,481,761 | A | 9/1949 | Leon | |
| 2,771,126 | A | 11/1956 | Stoll | |
| 3,104,913 | A | 9/1963 | Faulkner et al. | |
| 3,170,729 | A | 2/1965 | Grant | |
| 4,077,517 | A | 3/1978 | Hilemn | |
| 4,711,495 | A | 12/1987 | Magder | |
| 5,636,900 | A | 6/1997 | Wilkie et al. | |
| 5,738,414 | A | 4/1998 | Wieland et al. | |
| 5,795,028 | A | 8/1998 | Dussia, Jr. et al. | |
| 6,077,378 | A | 6/2000 | Bullard et al. | |
| 6,241,317 | B1 | 6/2001 | Wu | |
| 6,367,880 | B1 | 4/2002 | Niederman et al. | |
| 6,692,079 | B2 | 2/2004 | Guillot | |
| 6,796,614 | B1 | 9/2004 | Paul | |
| 6,827,407 | B2 | 12/2004 | Niederman et al. | |
| 6,942,298 | B2 | 9/2005 | Harrison | |
| 7,300,111 | B2 | 11/2007 | Huang | |
| 7,744,162 | B2 | 6/2010 | Griggs, Jr. | |
| 7,922,253 | B2 | 4/2011 | Chen | |
| 7,988,236 | B2 | 8/2011 | Brandtner | |
| 8,322,793 | B2 | 12/2012 | Chen | |
| 8,408,653 | B2 | 4/2013 | Griggs, Jr. | |
| 8,480,179 | B2 | 7/2013 | Griggs, Jr. | |
| 8,646,843 | B2 | 2/2014 | Koch | |
| 8,764,115 | B2 | 7/2014 | Brandtner | |
| 8,777,319 | B2 | 7/2014 | Brandtner et al. | |
| 9,028,003 | B2 | 5/2015 | Yeh | |
| 9,839,295 | B2 | 12/2017 | Robinson et al. | |
| 10,117,521 | B2 * | 11/2018 | Lewis | A47C 7/54 |
| 2004/0026970 | A1 | 2/2004 | Vassar et al. | |
| 2005/0017553 | A1 | 1/2005 | Duncan et al. | |
| 2005/0067876 | A1 | 3/2005 | Dortch | |
| 2005/0179303 | A1 | 8/2005 | Owens et al. | |
| 2005/0225153 | A1 | 10/2005 | Ou | |
| 2007/0143919 | A1 | 6/2007 | Erdman | |
| 2007/0290542 | A1 | 12/2007 | Wada | |
| 2009/0091166 | A1 | 4/2009 | Jha | |
| 2009/0235451 | A1 | 9/2009 | Gorkin | |
| 2010/0171346 | A1 | 7/2010 | Laframboise et al. | |
| 2012/0146382 | A1 | 6/2012 | Griggs, Jr. | |
| 2013/0134763 | A1 | 5/2013 | Koch | |
| 2013/0187420 | A1 | 7/2013 | Weinstein et al. | |
| 2013/0320741 | A1 | 12/2013 | Brandtner et al. | |
| 2014/0001812 | A1 | 1/2014 | Griggs, Jr. | |
| 2014/0053341 | A1 | 2/2014 | Parvin | |
| 2014/0091609 | A1 | 4/2014 | Van Der Jagt et al. | |
| 2014/0139000 | A1 | 5/2014 | Ogg | |
| 2014/0375103 | A1 | 12/2014 | Lejcher et al. | |
| 2015/0026881 | A1 | 1/2015 | Nault | |
| 2015/0305504 | A1 | 10/2015 | Robinson et al. | |
| 2017/0105545 | A1 * | 4/2017 | Lewis | A47C 17/02 |
| 2019/0254440 | A1 * | 8/2019 | Gates | A47C 31/04 |
| 2019/0290017 | A1 * | 9/2019 | Ross | A47C 17/86 |

* cited by examiner

UPHOLSTERED FURNITURE PIECE HAVING UPHOLSTERED ARM PANELS

CROSS-REFERENCE TO RELATED APPLICATIONS

This application is a continuation of U.S. application Ser. No. 15/299,316 filed Oct. 20, 2016, now U.S. Pat. No. 10,117,521 B2, which claims priority to U.S. Provisional Application No. 62/244,046 filed Oct. 20, 2015, the disclosures of which are hereby incorporated by reference in their entireties.

FIELD OF THE DISCLOSURE

The disclosure relates to furniture construction, and in particular, to the manufacture of furniture that is upholstered. More specifically, the disclosure relates to the manufacture of upholstered furniture arms. Even more specifically, the disclosure relates to the manufacture of upholstered furniture arms where the arm panel stump is provided with a curvature at its top end. Even more specifically, the disclosure relates to the manufacture of upholstered furniture arms where the curvature is surrounded by EVA foam as an underlayment material and cushioning material and finishing material are layered, respectively, over the EVA foam.

BACKGROUND OF THE DISCLOSURE

In the manufacture of upholstered furniture, such as sofas and chairs, it is desirable to manufacture and assemble the arm panels with a variety of cushioning materials and upholstery. Generally, due to the construction of the arm panel frame, the arm panel cushioning is multi-layered to provide a sufficient level of comfort to the user. It is common for an arm panel to be comprised of a wood or wood product frame, a layer of cardboard, a layer of polyester padding, a strip of edge roll around the exposed front edges of the frame, a layer of low melt fiber, and a layer of upholstery fabric. The edge roll provides protection to the edges of the arm frame and gives a round edge.

Arm panel frames have a top end that can be shaped to provide differing aesthetic qualities. Many of the top ends are curved, round, or oval shaped. The top end is generally constructed with a number of wood slats, having rectangular cross sections that butt up against and are horizontally attached between the front and rear arm panel stumps. The wood slats are spaced apart thus resulting in exposed edges and flat surfaces around the top end. In a curved top end, it is desirable to provide for a smooth top end so that the consumer does not feel the wood slat edges. As such, it is known to use cardboard as the underlayment where the cardboard is placed over the wood slats and then attached to the frame. The cardboard provides a somewhat smooth plane of curvature over the edges of the wood slats. Cushioning materials are then placed over the cardboard and attached to the frame.

In constructing an arm panel frame, each layer is individually positioned over the frame and attached to the frame with a large number of fasteners, such as staples. After installation of a layer, another layer or edge roll is then placed and attached. In one example, the cardboard layer is correctly positioned over the arm frame and attachment is accomplished using 5 rows of staples with each row averaging 14 staples. Once the cardboard layer is correctly attached, the edge roll can be attached, using approximately 12 staples. The polyester padding is then placed and correctly positioned so that it butts up against the edge roll and covers the cardboard layer. Approximately 20 staples are then used to attach the polyester padding to the frame. The low melt fiber material is then placed and correctly positioned so that it covers and extends beyond the polyester padding and is attached to the frame using approximately 30 to 40 staples. Completion of the arm panel entails a final covering of upholstery fabric that is placed and correctly positioned to entirely cover and extend beyond the low melt fiber material. The upholstery fabric is stretched taut over the frame and is attached with staples to the frame thus completing the assembly.

The above process of manufacturing the upholstered arm panel is time consuming and costly since a number of parts must be assembled to construct the arm panel and a large number of fasteners must be placed. As such, a simplified method for manufacturing upholstered furniture and arm panels that reduces labor and material costs while providing a product that provides a sufficient or improved level of comfort to the user would be welcomed.

SUMMARY OF THE DISCLOSURE

The disclosure addresses the need in the furniture manufacturing industry for a cost-effective and efficient way of providing upholstered arm panels that provide an expected and sufficient level of comfort to the user while also providing a structurally sound and sturdy product.

In one embodiment, a sofa with an upholstered arm panel has a layered composition comprising an underlayment material layer, a low melt fiber material layer positioned on top of and contacting the underlayment material layer, and a covering material layer positioned on top of and contacting the low melt fiber material layer. In one embodiment, the underlayment material layer is comprised a planar sheet of Ethylene-vinyl acetate copolymer foam (EVA foam). The use of EVA foam reduces the number of structural and cushioning materials currently required in arm panel construction and greatly reduces the number of fasteners or staples that are required to fasten these materials to the arm panel. The result is that assembly is more efficient due to removed work content, thus saving labor and material costs.

The use of EVA foam replaces the known practice of using cardboard as the underlayment layer and, due to its thickness and resiliency, acts as a replacement for the known practice of using polyurethane foam as a layer of cushioning atop the underlayment layer. In addition, the currently known practice is to use an edge roll around the front face of the arm panel frame to cushion and round the edges of the front face. The edge roll is generally located around the arm top end and extends down the inner side of the arm panel frame. Due to the thickness and cushioning properties of the EVA foam, the use of the edge roll can be negated by extending the edge of the EVA foam over the front face of the front arm panel stump. Optionally, an approximately three to six inch piece of edge roll, with one end butted to the EVA foam, can be placed on the side of the front face of the front arm panel frame adjacent the seat base to provide cushioning near the leg of the user. It is apparent that the use of EVA foam as the underlayment material reduces the number of materials needed for the initial cushioning layer from three to one. In addition, the number of fasteners and installation labor is correspondingly reduced. For example, in one embodiment, the number of fasteners needed was reduced by 70% by using EVA foam as an underlayment. Application of fasteners can be a time-consuming process, is very tedious, and it is difficult to get the fasteners perfectly spaced and positioned. Thus, any reduction in the number of fasteners can result in a reduction in labor and material costs.

Closed cell EVA foam is a lightweight material that has the characteristics of being bendable and flexible without the material fracturing and of conforming to fit the required shape, generally curvature in nature. Moreover closed cell EVA foam has very low water absorption. For example, in one embodiment, in an arm panel frame having a curved top end, the EVA foam would begin at the start of the curvature and end slightly beyond the end of the curvature and on the top end of the side panel. EVA foam has the added advantage of retaining a smooth top surface even when flexed to form a curved shape over spaced apart boards. In addition, EVA foam is capable of receiving and retaining fasteners without damaging the material. Other materials have been studied to be used as underlayment, and while they can be used in some embodiments, they do not provide the same benefits as EVA foam. For example, heavy duty foams, such as carpet pads or foam backed rugs, are costly and add weight to the arm panel and typically absorb moisture. Also, lighter weight foams, such as fatigue pads, may, in some instances, be too soft or incapable of providing the needed structure and weight bearing capabilities.

EVA foams with a density of 0.08 to 0.30 gms/cm$^3$ are suitable for the EVA herein. In some embodiments, 0.11 to 0.20 gms/cm$^3$ are suitable. The EVA foam thickness is, in some embodiments, 0.5 to 1.5 cm thick. In some embodiments the EVA foam is 0.6 to 1.1 cm thick. In some embodiments the EVA foam is 0.75 to 3 cm thick.

Additional suitable specifications of various embodiments of the disclosure are compression set (ASTM-D395(%) of 46 to 65. Additional suitable specifications of various embodiments are tensile strength (kg/cm$^2$) of 25-35. In some embodiments of the disclosure, other polymer foams are utilized with these specifications, or combinations of these specifications.

According to various embodiments of the disclosure, an upholstered sofa comprises a sofa frame having a rectangular seat base with an upright back rest portion integral with the seat base, and a right arm panel frame and a left arm panel frame integral with the seat base and back rest portion wherein the seat base and back rest are disposed between the right arm panel frame and the left arm panel frame. The seat base has a rectangular shape and forms a box frame having a left side, a right side, a front side, and a back side defining an open interior space. The back rest portion is affixed to the back side of the seat base and between the right arm panel frame and the left arm panel frame so that the back rest portion is in an upright position. The arm panel frames each comprise a vertical front arm stump panel having an inwardly facing side, an outwardly facing side, and a top end having a curvature extending at least 270 degrees and a downward face. The arm panel frame can have a vertical back arm stump panel having an inwardly facing side, an outwardly facing side, and a top end having a curvature extending at least 270 degrees and a downward face. The arm panel frame further comprising a bottom member integral with and disposed between the front arm stump panel inwardly facing side and the back arm stump panel inwardly facing side. A plurality of wooden slats, having rectangular cross-sections, are disposed and integrally affixed between the inwardly facing side top end of the front arm stump panel and the inwardly facing side top end of the back arm stump panel so that the wooden slats are spaced apart and follow the curvature of the top end of the front arm stump panel and the top end of the back arm stump panel. The arm panel frame can have a horizontal wood slat, with a rectangular cross-section, integrally affixed between the inwardly facing side of the front arm stump panel at a terminus adjacent the downward face of the top end and the inwardly facing side of the back arm stump panel at a terminus adjacent the downward face of the top end. The arm panel frame can have an inner panel integral with and affixed between the inwardly facing side of the front arm stump panel and the inwardly facing side of the back arm stump panel opposite the attachment member.

In some embodiments, the upholstered sofa can have a flexible, compressible underlayment material comprised of a planar sheet of an Ethylene-vinyl acetate copolymer. The underlayment material having a first edge, a second edge, and a front edge. The first edge attached with a plurality of fasteners to the horizontal wood slat, the second edge attached with a plurality of fasteners to the inner panel, and the front edge of the underlayment material positioned to extend past the outwardly facing side of the front arm stump panel by about 0.25 inches to about 0.5 inches.

The upholstered sofa can have a vertically oriented edge roll having a top end and a bottom end where the top end is butted against the underlayment material second edge and is fixedly attached to the outwardly facing side of the front arm stump panel with a plurality of fasteners.

In some embodiments, the upholstered sofa can have a low melt fiber material positioned on top of and contacting the underlayment material. The low melt fiber material has a first edge, a second edge, and a front edge. The second edge and the front edge both extend beyond the corresponding underlayment material second edge and front edge. The low melt fiber material can be fixedly attached with a plurality of fasteners at the first edge to the horizontal wood slat and at the second edge to the inner panel. The front edge can be fixedly attached with a plurality of fasteners to the outwardly facing side of the front arm stump panel.

A finishing material can be positioned on top of and contacting the low melt fiber material. The finishing material has a first edge, a second edge, a back edge, and a front edge. The edges can extend beyond the corresponding low melt fiber material edges. The finishing material can be fixedly attached with a plurality of fasteners at the first edge and at the second edge to the arm panel frame bottom member. The back edge can be fixedly attached with a plurality of fasteners to the outwardly facing side of the back arm stump panel, and the front edge can be fixedly attached with a plurality of fasteners to the outwardly facing side of the front arm stump panel.

In some embodiments, the planar sheet of Ethylene-vinyl acetate copolymer has a thickness of about 8 mm±0.5 mm, a molecular weight of about 2,000 g/mol±10% and a hardness of about 50 A to about 55 A based on the Shore durometer hardness test.

In some embodiments, the underlayment material can be comprised of foams.

In some embodiments, the box frame left side and box frame right side can be the arm panel frame inner panels.

In one embodiment, an upholstered furniture arm has an arm panel frame, the frame having a vertical front arm stump panel having an inwardly facing side, an outwardly facing side, and a top end having a curvature extending at least 270 degrees and a downward face. The arm panel frame can have a vertical back arm stump panel having an inwardly facing side, an outwardly facing side, and a top end having a curvature extending at least 270 degrees and a downward face. The arm panel frame further comprising a bottom member integral with and disposed between the front arm stump panel inwardly facing side and the back arm stump panel inwardly facing side. A plurality of wooden slats, having rectangular cross-sections, are disposed and integrally affixed between the inwardly facing side top end of the front arm stump panel and the inwardly facing side top end of the back arm stump panel so that the wooden slats are spaced apart and follow the curvature of the top end of the front arm stump panel and the top end of the back arm stump panel. The arm panel frame can have a horizontal wood slat, with a rectangular cross-section, integrally affixed between the inwardly facing side of the front arm stump panel at a terminus adjacent the downward face of the top end and the inwardly facing side of the back arm stump panel at a terminus adjacent the downward face of the top end. The arm panel frame can have an inner panel integral with and affixed between the inwardly facing side of the front arm stump panel and the inwardly facing side of the back arm stump panel opposite the attachment member.

In another embodiment the front arm stump panel having a curvature of at least 180 degrees.

In one embodiment, an upholstered furniture arm can have a flexible, compressible underlayment material comprised of a planar sheet of an Ethylene-vinyl acetate copolymer. The underlayment material having a first edge, a second edge, and a front edge. The first edge attached with a plurality of fasteners to the horizontal wood slat, the second edge attached with a plurality of fasteners to the inner panel, and the front edge of the underlayment material positioned to extend past the outwardly facing side of the front arm stump panel by about 0.25 inches to about 0.5 inches.

The upholstered arm can have a vertically oriented edge roll having a top end and a bottom end where the top end is butted against the underlayment material second edge and is fixedly attached to the outwardly facing side of the front arm stump panel with a plurality of fasteners.

In one embodiment, an upholstered furniture arm can have a low melt fiber material positioned on top of and contacting the underlayment material. The low melt fiber material has a first edge, a second edge, and a front edge. The second edge and the front edge both extend beyond the corresponding underlayment material second edge and front edge. The low melt fiber material can be fixedly attached with a plurality of fasteners at the first edge to the horizontal wood slat and at the second edge to the inner panel. The front edge can be fixedly attached with a plurality of fasteners to the outwardly facing side of the front arm stump panel.

In one embodiment, an upholstered furniture arm can have a finishing material positioned on top of and contacting the low melt fiber material. The finishing material has a first edge, a second edge, a back edge, and a front edge. The edges can extend beyond the corresponding low melt fiber material edges. The finishing material can be fixedly attached with a plurality of fasteners at the first edge and at the second edge to the arm panel frame bottom member. The back edge can be fixedly attached with a plurality of fasteners to the outwardly facing side of the back arm stump panel, and the front edge can be fixedly attached with a plurality of fasteners to the outwardly facing side of the front arm stump panel.

In one embodiment, an upholstered furniture arm can have the planar sheet of Ethylene-vinyl acetate copolymer has a thickness of about 8 mm±0.5 mm, a molecular weight of about 2,000 g/mol and a hardness of about 50 A to about 55 A based on the Shore durometer hardness test. In some embodiments, the underlayment material can be comprised of foams.

In one embodiment, a method of assembling an upholstered sofa comprises receiving a sofa frame. The sofa frame having a rectangular seat base with an upright back rest portion integral with the seat base, and a right arm panel frame and a left arm panel frame integral with the seat base and back rest portion. The seat base and back rest are disposed between the right arm panel frame and the left arm panel frame. The seat base has a rectangular shape and forms a box frame having a left side, a right side, a front side, and a back side defining an open interior space. The back rest portion is affixed to the back side of the seat base and between the right arm panel frame and the left arm panel frame so that the back rest portion is in an upright position. The arm panel frames each comprise a vertical front arm stump panel having an inwardly facing side, an outwardly facing side, and a top end having a curvature extending at least 270 degrees and a downward face. The arm panel frame further comprising a vertical back arm stump panel having and inwardly facing side, an outwardly facing side, and a top end having a curvature extending at least 270 degrees and a downward face. The arm panel frame further comprising a bottom member integral with and disposed between the front arm stump panel inwardly facing side and the back arm stump panel inwardly facing side. A plurality of wooden slats, having rectangular cross-sections, are disposed and integrally affixed between the inwardly facing side top end of the front arm stump panel and the inwardly facing side top end of the back arm stump panel so that the wooden slats are spaced apart and follow the curvature of the top end of the front arm stump panel and the top end of the back arm stump panel. The arm panel frame further comprises a horizontal wood slat, with a rectangular cross-section, integrally affixed between the inwardly facing side of the front arm stump panel at a terminus adjacent the downward face of the top end and the inwardly facing side of the back arm stump panel at a terminus adjacent the downward face of the top end. The arm panel frame further comprising an inner panel integral with and affixed between the inwardly facing side of the front arm stump panel and the inwardly facing side of the back arm stump panel opposite the attachment member.

The method of assembling an upholstered sofa further includes receiving a flexible, compressible underlayment material comprised of a planar sheet of an Ethylene-vinyl acetate copolymer. The underlayment material having a first edge, a second edge, and a front edge. Attaching the first edge with a plurality of fasteners to the horizontal wood slat. Attaching the second edge with a plurality of fasteners to the inner panel, and positioning the front edge of the underlayment material to extend past the outwardly facing side of the front arm stump panel by about 0.25 inches to about 0.5 inches.

The method of assembling entails receiving a vertically oriented edge roll having a top end and a bottom end, and butting the top end against the underlayment material second edge and fixedly attaching the edge roll to the outwardly facing side of the front arm stump panel with a plurality of fasteners.

The method of assembling further entails receiving a low melt fiber material. Positioning the low melt fiber material on top of and contacting the underlayment material. The low melt fiber material has a first edge, a second edge, and a front edge, extending both the second edge and the front edge beyond the corresponding underlayment material second edge and front edge. Fixedly attaching the low melt fiber material with a plurality of fasteners at the first edge to the horizontal wood slat and at the second edge to the inner panel. Fixedly attaching the front edge with a plurality of fasteners to the outwardly facing side of the front arm stump panel.

The method of assembling further entails receiving a finishing material and positioning the finishing material on top of and contacting the low melt fiber material wherein the finishing material has a first edge, a second edge, a back edge, and a front edge. Extending the edges beyond the corresponding low melt fiber material edges and fixedly attaching the finishing material with a plurality of fasteners at the first edge and at the second edge to the arm panel frame bottom member. The method further entails fixedly attaching the back edge with a plurality of fasteners to the outwardly facing side of the back arm stump panel, and fixedly attaching the front edge with a plurality of fasteners to the outwardly facing side of the front arm stump panel.

A feature and advantage of embodiments of the invention is a sofa arm with only two layers of material between the wood arm frame and the upholstery covering. The wood arm frame having a top curved frame about a horizontal axis. The layers comprising an EVA underlayer and a second layer of fibrous material thereon. A feature and advantage is the sofa arm does not have a cardboard layer extending across the top curved frame as in conventional assembly techniques. Moreover, the top curved frame does not have an edge roll about the front edge of the curved frame but utilizes the front edge of the EVA layer instead.

DETAILED DESCRIPTION

Figure 1:
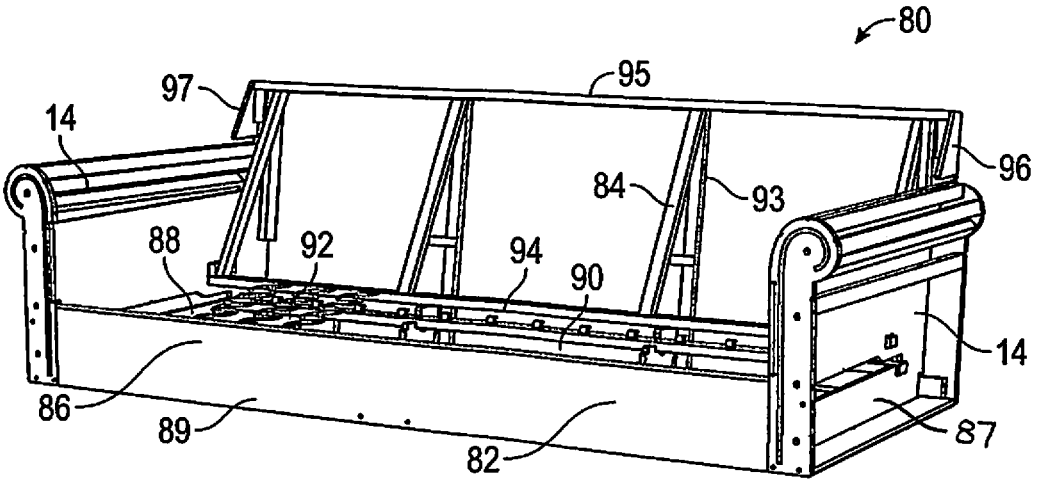
FIG. 1 is a perspective view of a sofa frame according to an embodiment of the disclosure.

Referring to FIG. 1, sofa furniture frame 80 is illustrated according to an embodiment of the disclosure. The frame 80 comprises a seat base 82 and an upright back rest portion 84 integral with the seat base 82, "integral" in that components are fixed together at the factory with permanent fasteners, glue, and may have common frame members and they are not detachable from one another without damage. The seat base 82 comprises a box frame 86 comprising a rectangular shape and having a left side 87, a right side 88, a front side 89, a back side 90, so that the box frame 86 defines an open interior space 92. The back rest portion 84 can further comprise a back side 93, a bottom side 94, a top 95, a left side 96, and a right side 97. The back rest portion 84 is affixed to the back side 90 of the seat base 82. The back rest portion 84 has an upright position where it is seated and secured to the seat base 82 as shown. The furniture frame 80 can further comprise a pair of arm panel frames 14 where the seat base 82 and back rest portion 84 are disposed between the arm panel frames 14 such that the box frame 86 left side 87 and right side 88 and the back rest portion 84 left side 96 and right side 97 are integral to the corresponding arm panel frames 14. In some embodiments, the furniture frame 80 comprises wood or wood products. Furniture frames 80 of varying configurations are contemplated and it is apparent that frames 80 of varying configurations are within the spirit and scope of this disclosure.

Figure 2:
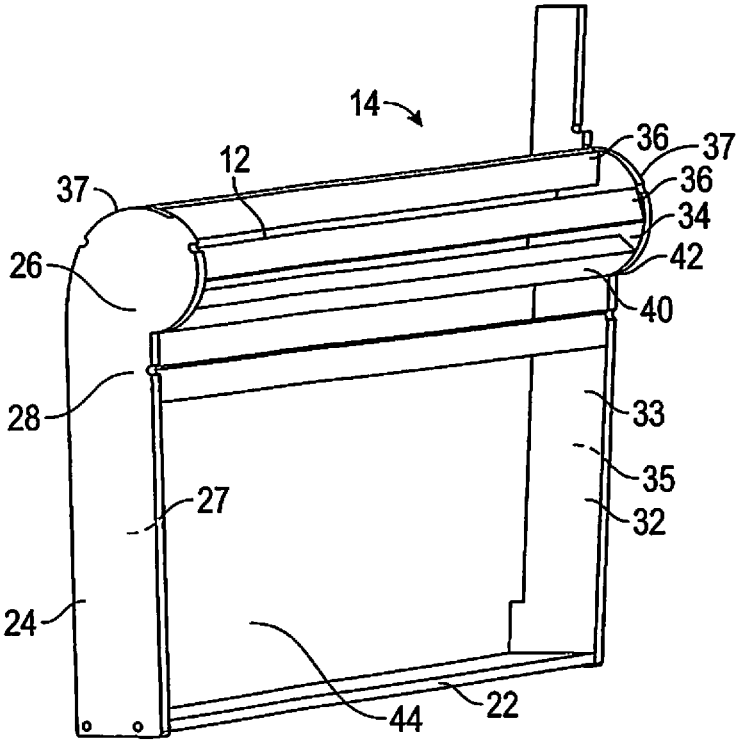
FIG. 2 is a perspective outer side view of an arm panel frame according to an embodiment of the disclosure.
Figure 3:
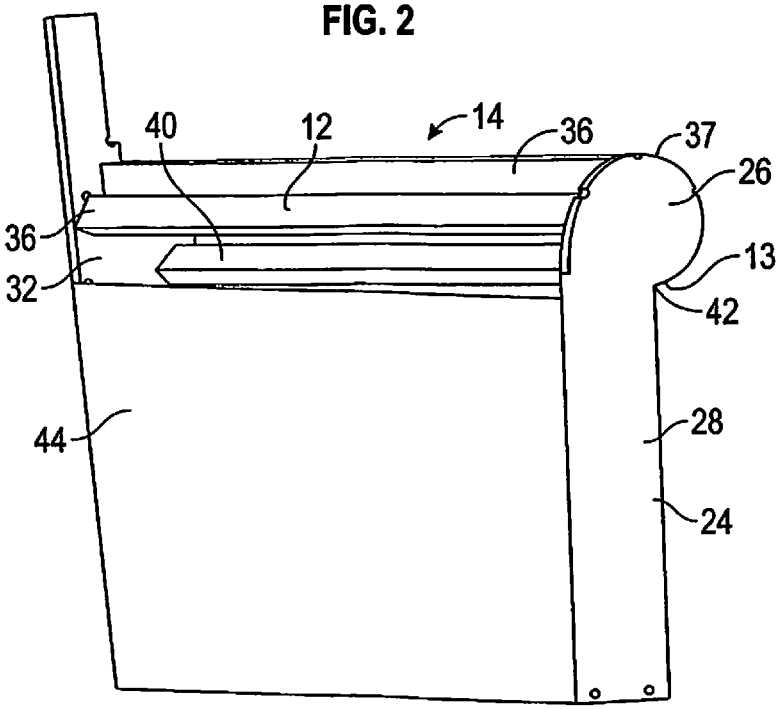
FIG. 3 is a perspective inner side view of an arm panel frame according to an embodiment of the disclosure.

Referring to FIGS. 2 and 3, one embodiment of an arm panel frame 14 is illustrated. Arm panel frame 14 can include a vertical front arm stump panel 24 having a top end 26 with a curvature 37, an inwardly facing side 27, and an outwardly facing side 28, and a vertical back arm stump panel 32 having a top end 34 with a curvature 37, an inwardly facing side 33, and an outwardly facing side 35. The arm panel frame can further include a bottom member 22 integral with and disposed between the front arm stump panel 24 inwardly facing side 27 and the back arm stump panel 32 inwardly facing side 33. The arm panel frame further includes a plurality of wooden slats 36, having rectangular cross-sections, integrally affixed between the inwardly facing side 27 top end 26 of the front arm stump panel 24 and the inwardly facing side 33 top end 34 of the back arm stump panel 32 to form a top end 12 of the arm panel frame 14 where the top end 12 has a curvature. The arm panel frame 14 further comprises a horizontal attachment wood slat 40, having a rectangular cross-section, integrally affixed between the inwardly facing side 27 of the front arm stump panel 24 at a terminus 42 of the top end 26 and the inwardly facing side 33 of the back arm stump panel 32 at a terminus 42 of the top end 34. The arm panel frame 14 can also have an inner panel 44 affixed between the inwardly facing side 27 of front arm stump panel 24 and the inwardly facing side 33 of the back arm stump panel 32 opposite the attachment member 40.

In one embodiment, the furniture frame 80 can further comprise a box frame 86 where the left side 87 and right side 88 panels of the box frame 86 are comprised of the arm panel frame 14 inner panels 44. The box frame 86 front side 89 and back side 90 are disposed between and integral with the arm panel frame 14 inner panels 44 such that the inner panels 44 comprise the box frame 86 left side 87 and right side 88. The back rest portion 84 left side 96 and right side 97 are disposed between and are integral to the corresponding arm panel frames 14.

The arm panel frame 14 is generally constructed of wood or wood product. However, other materials can be used that provide sufficient support and stability, for example, plastics, metals, and closed-cell extruded polystyrene foams.

Figure 4:
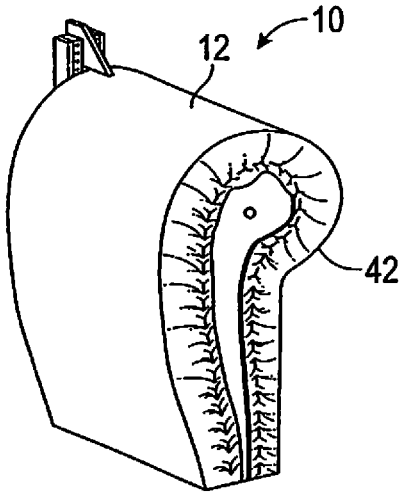
FIG. 4 is a perspective view of an upholstered arm panel according to an embodiment of the disclosure.
Figure 5:
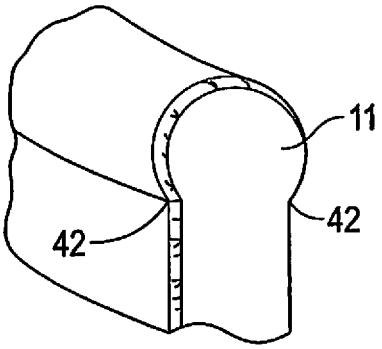
FIG. 5 is a partial, perspective front view of an upholstered arm panel top end according to an embodiment of the disclosure.
Figure 6:
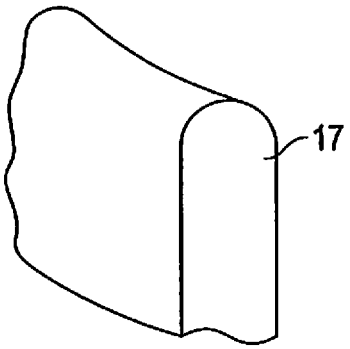
FIG. 6 is a partial, perspective front view of an upholstered arm panel top end according to an embodiment of the disclosure.

FIG. 4 illustrates an upholstered arm panel 10 that can be a component of the furniture frame 80. While FIG. 4 illustrates an arm panel 10 having a curved arm stump panel top end 12, where the curvature 37 extends at least 270 degrees and includes a downward face 13, it is understood to those with skill in the relevant art that the top end 12 could be of various configurations, including but not limited to, round 11 and oval 17, as shown in FIGS. 5 and 6, respectively, and variations thereof. Additionally, while FIGS. 2-9 illustrate a left-hand arm panel 10, it is apparent that a right-hand arm panel is within the spirit and scope of this disclosure.

Figure 7:
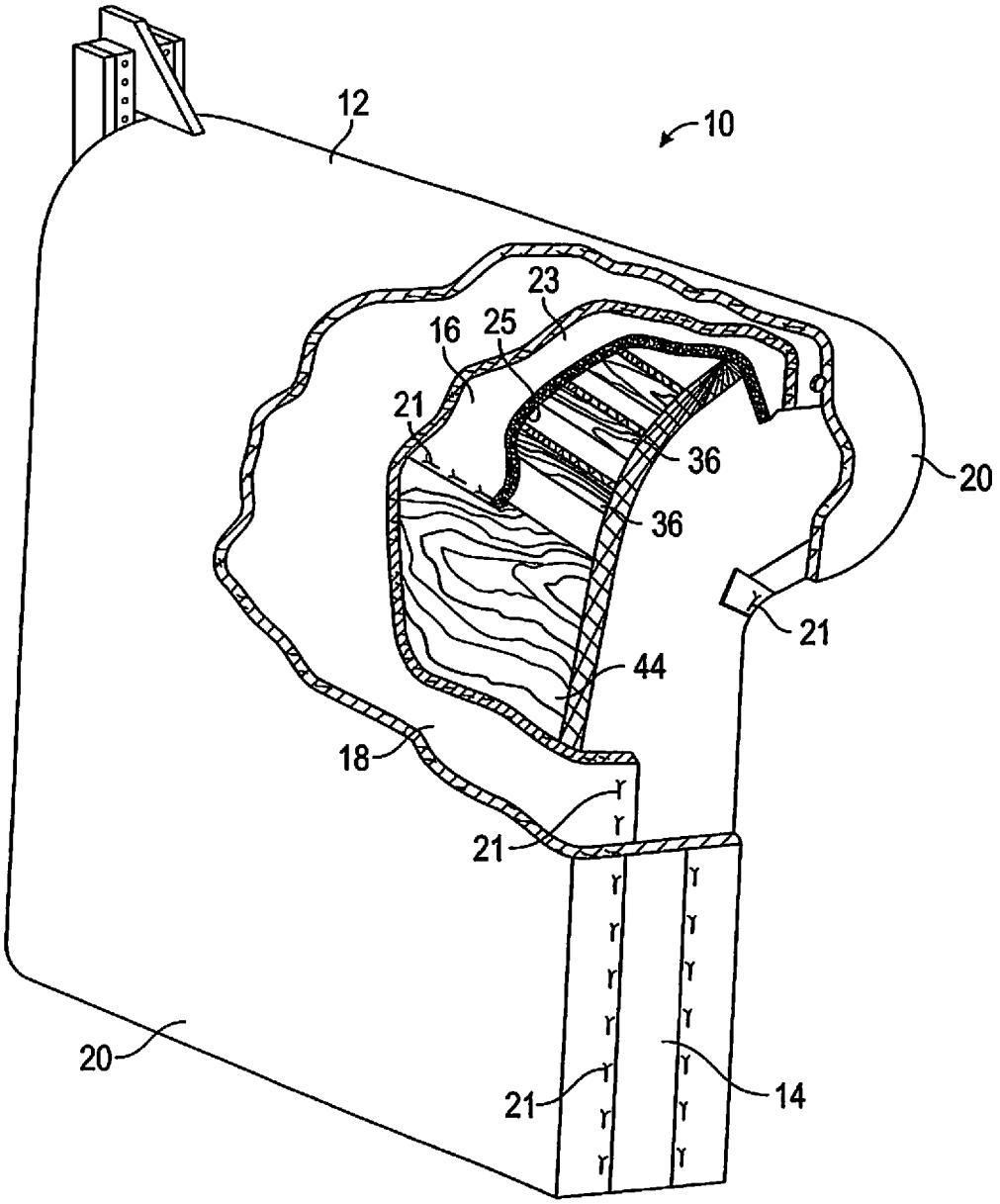
FIG. 7 is a perspective cut-away view of an upholstered arm panel according to an embodiment of the disclosure.
Figure 8A:
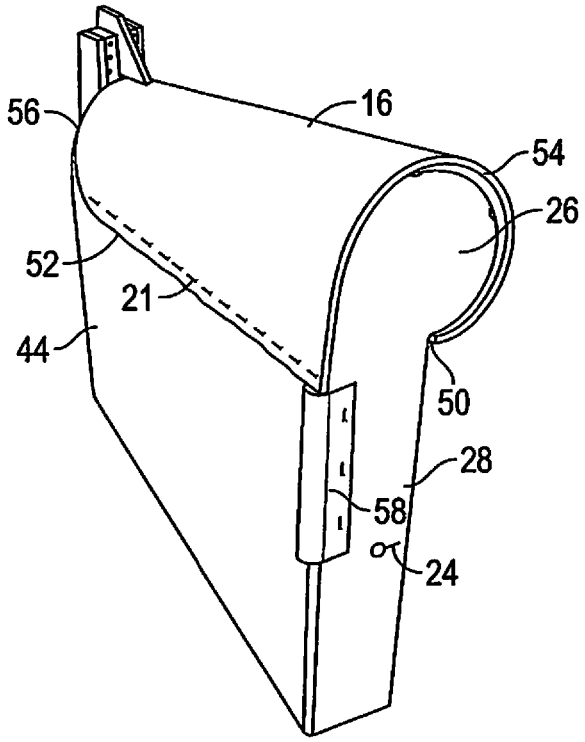
FIG. 8A is a perspective view of an arm panel frame detailing the affixed underlayment layer and optional edge roll according to an embodiment of the disclosure.
Figure 8B:
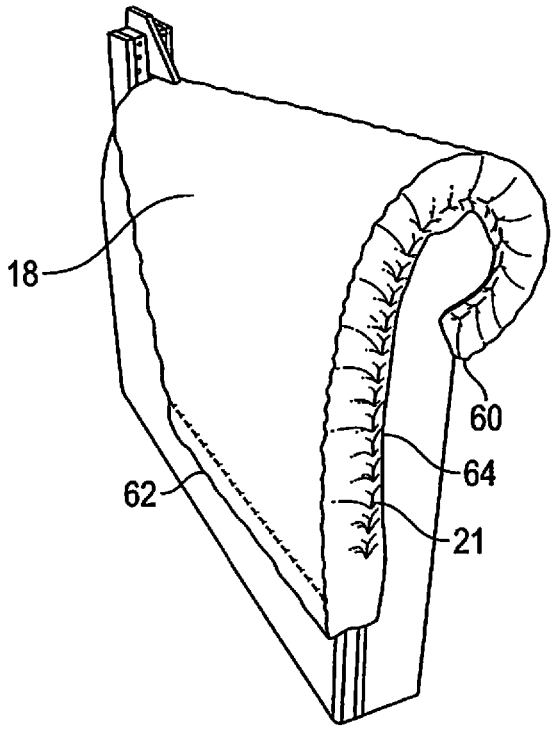
FIG. 8B is a perspective view of an arm panel frame detailing the affixed low melt fiber layer according to an embodiment of the disclosure.
Figure 8C:
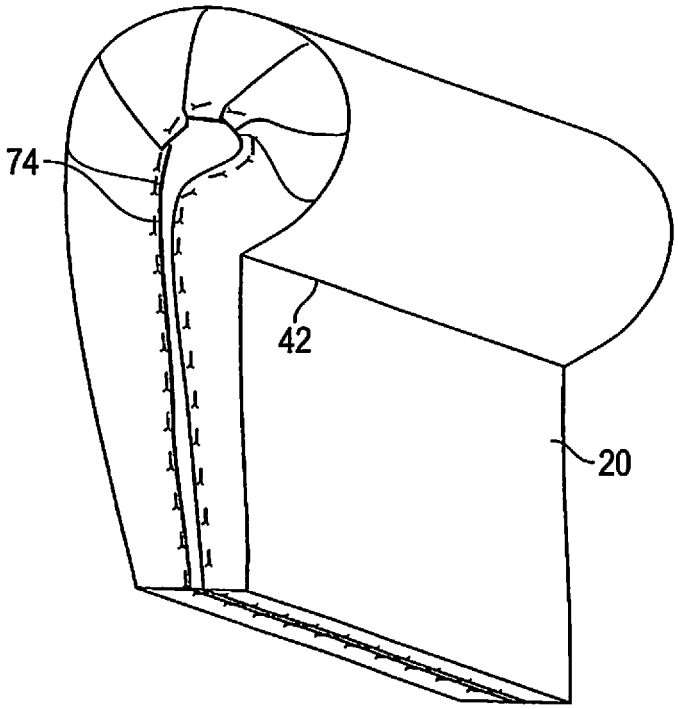
FIG. 8C is a perspective view of an arm panel frame detailing the affixed material covering layer according to an embodiment of the disclosure.
Figure 9:
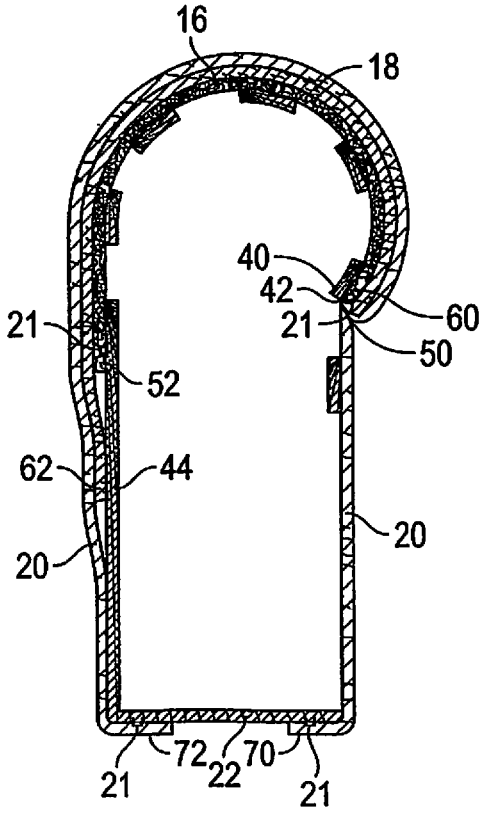
FIG. 9 is a perspective cross sectional view of an upholstered arm panel according to embodiments of the disclosure.

FIGS. 7 through 9 illustrate an embodiment including the constituent parts of an upholstered arm panel 10. FIG. 7 illustrates an arm panel 10 comprising an arm panel frame 14, a self-supporting, bendable underlayment material layer 16, a low melt fiber material layer 18 and a finishing material layer 20. The underlayment material layer 16, low melt fiber material layer 18 and finishing material layer 20 are generally similarly shaped and can be of different sizes.

The underlayment material layer 16 is positioned on the arm panel frame 14 so that it provides the bottom layer of the completed layered composition. The low melt fiber material layer 18 is positioned on top of the underlayment material layer 16 so that the low melt fiber material layer is in contact with the underlayment material layer 16. The finishing material layer 20 is positioned on top of the low melt fiber material layer 18 so that the finishing material layer 20 is in contact with the low melt fiber material layer 18. Hence, a layered composition comprises a finishing material layer 20 on top of a low melt fiber material layer 18, on top of an underlayment material layer 16. However, other layers and sequence of layers are contemplated.

Each of the material layers 16, 18, 20 can receive and retain fasteners 21, such as staples, where the fastener 21 enters one layer of material 16, 18, 20, through the top side 23 and exits through the bottom side 25 and affixes to the arm panel frame 14, thus effectively sandwiching the material 16,18, 20 between the head of the fastener 21 and the arm panel frame 14. In other embodiments, adhesives can be used to affix the materials 16, 18, 20. An optional edge roll 58 can also be affixed, using fasteners or adhesives, to the arm panel frame 14, as detailed in FIG. 8A.

The underlayment material layer 16 includes the characteristics of being bendable and flexible without the underlayment material layer 16 fracturing. The underlayment material layer 16 also includes the hardness characteristic of being slightly compressible under force and uncompresses when force is removed. Generally, the underlayment material layer 16 forms the bottom layer or base layer of the layered composition so that one side of the underlayment material 16 is in contact with the wooden slats 36 that comprise the top end 12. The underlayment material layer 16 must be of sufficient thickness and hardness, while retaining flexibility, such that the user will not feel the wooden slats 36 through the underlayment material 16 but will be provided an adequate level of support and structure. In one embodiment, the underlayment material layer 16 can be a planar sheet of an Ethylene-vinyl acetate copolymer (EVA foam) that can be flexed to form a curved sheet having a curved planar surface. In one embodiment, the EVA foam 16 can have a molecular weight of about 2,000 g/mol, a thickness of about 8 mm±0.5 mm, and a hardness of about 50 A to about 55 A based on the Shore durometer hardness test. In other embodiments, the EVA foam can have differing molecular weights, thicknesses, and hardnesses, so long as the EVA foam provides the structural stability and support necessary while still providing a bendable and flexible underlayment material layer 16. In other embodiments, the underlayment material layer 16 can be comprised of a foam where the term foam refers to anything that is analogous to a foam, such as quantum foam, polyurethane foam (foam rubber), XPS foam, polystyrene, phenolic, or many other manufactured foams.

Referring to FIGS. 8A and 9, the underlayment material layer 16 can have a first edge 50, a second edge 52 opposite the first edge 50, a front edge 54, and a back edge 56. The underlayment material layer 16 is disposed adjacent the arm frame 14 at the top end 12 and is sized so that it covers the arm panel top end 12 with the front edge 54 positioned to about 0.25 inches from the front face 28 top end 26. In another embodiment, the front edge 54 is positioned to project about 0.5±0.25 inches from the front face 28 top end 26. The first edge 50 is fixedly attached, using fasteners 21 placed in a generally straight line adjacent the first edge 50, to the horizontal wood slat 40. The second edge 52 is fixedly attached, using fasteners 21 placed in a generally straight line adjacent the second edge 52, to the inner panel 44. By attaching the underlayment material layer 16 as detailed, the underlayment material layer 16 overlays and covers the wood slats 36 and edges of the arm panel stumps 24, 32 providing a solid, curved surface. The underlayment material layer 16 is thus formed into a desired shape, for example, the curvature of the arm panel top end 12, while using a minimal number of fasteners 21.

In one embodiment, as shown in FIG. 8A, an optional edge roll 58 can be vertically attached, using fasteners, to the front panel 24. The edge roll 58 butts up to the second edge 52 of the underlayment material layer 16 where the second edge 52 projects from the front face 28. The edge roll 58 can be about 0.5±0.25 inches in diameter and provides a layer of cushioning and a roundish edge to the juncture of the inner panel 44 and the front panel 24.

In one embodiment, the low melt fiber material layer 18 is a high density cushioning material that is comprised of polyester or polyester compounds. The low melt fiber material layer 18 can be provided in differing thicknesses and resiliencies where the thickness and resiliency used is dependent on the application. In one embodiment, the low melt fiber material layer 18 can be conjugated polyester fiber. However, other types of cushioning materials having resilient properties are contemplated.

Referring to FIGS. 8B and 9, the low melt fiber material layer 18 is disposed adjacent to and sized so that it covers the underlayment material layer 16. The low melt fiber material layer 18 has a first edge 60, a second edge 62 opposite the first edge 60, and a front edge 64. The front edge 64 and the second edge 62 can project beyond the underlayment material layer 16 front edge 54 and second edge 52. The low melt fiber material layer 18 first edge 60 is aligned with the underlayment material layer 16 first edge 50 and is fixedly attached to the horizontal wooden slat 40, using fasteners 21 placed in a generally straight line adjacent the first edge 60. The low melt fiber material layer 18 is sized so that the second edge 62 is fixedly attached to the inner panel 44 nearer the inner panel 44 juncture with the bottom member 22. The second edge 62 is fixedly attached to the inner panel 44 using fasteners 21 placed in a generally straight line adjacent the second edge 62. The low melt fiber material layer 18 front edge 64 extends beyond the underlayment material layer 18 front edge 54, and the edge roll 58, if provided, and is fixedly attached, using fasteners 21, to the outwardly facing side 28 of the vertical front arm stump panel 24 so that the low melt fiber material layer 18 envelopes the front edge 54 of the underlayment material layer 16 and the optional edge roll 58.

Referring to FIGS. 8C and 9, the finishing material layer 20 is disposed adjacent to and sized so that it covers the low melt fiber material layer 18. The finishing material layer 20 has a first edge 70, a second edge 72 opposite the first edge 70, a front edge 74, and a back edge 76. The finishing material layer 20 is positioned atop the low melt fiber material layer 18 and the edges 70, 72, 74 of the finishing material layer 20 project beyond the edges 60, 62, 64 of the low melt fiber material layer 18. The finishing material layer 20 envelopes the arm panel frame 14 so that the first edge 70 can be fixedly attached to the bottom side of the bottom member 22, the second edge 72 can be fixedly attached to the bottom side of the bottom member 22, and the front edge 74 can be fixedly attached to the outwardly facing side 28 of the front arm stump panel 24. Attachment is made using fasteners 21 placed in a generally straight line adjacent the edges 70, 72, 74. In some embodiments, as illustrated in FIG. 8C, the finishing material layer 20 can be fixedly attached to the arm panel frame 14 at the top end terminus 42. The finishing material layer 20 back edge 76 is further wrapped around and fixedly attached, using fasteners 21, to the outwardly facing side 35 of the back arm stump panel 32 thus resulting in a finished layered assembly.

It is apparent to those with skill in the relevant art that various embodiments of an arm panel frame 14 can be constructed that have variations of member placement dependent on the top end 12 configuration, the areas in which the material layers 16, 18, 20 are to be affixed, and overall furniture aesthetics. Thus, while this disclosure discusses fastening the material layers 16, 18, 20 to specific areas of one embodiment of an arm panel frame 14, it is understood by those with skill in the relevant art that the material layers 16, 18, 20 can be fastened to any location on the arm panel frame 14, or on other components of the furniture frame 80, or other embodiments of arm panel frames so long as the structure or operation fall within the scope of the disclosure.

While the disclosure is amenable to various modifications and alternative forms, specifics thereof have been shown by way of example in the drawings and described in detail. It is understood however, that the intention is not to limit the application to the particular embodiments described. On the contrary, the intention is to cover all modifications, equivalents, and alternative falling with the spirit and scope of the disclosure as defined by the appended claims.

Persons of ordinary skill in the relevant arts will recognize that various embodiments can comprise fewer features than illustrated in any individual embodiment described above. The embodiments described herein are not meant to be an exhaustive presentation of the ways in which the various features may be combined. Accordingly, the embodiments are not mutually exclusive combinations of features; rather, the claims can comprise a combination of different individual features selected from different individual embodiments, as understood by persons of ordinary skill in the art.

References to "embodiment(s)", "disclosure", "present disclosure", "embodiment(s) of the disclosure", "disclosed embodiments", and the like contained herein refer to the specification (text, including the claims, and figures) of this patent application that are not admitted prior art.

For purposes of interpreting the claims, it is expressly intended that the provisions of 35 U.S.C. 112(f) are not to be invoked unless the specific terms "means for" or "step for" are recited in the respective claim.

What is claimed is:

1. An upholstered sofa comprising:

a sofa frame including a seat base and a right arm panel frame and a left arm panel frame attached to the seat base, wherein each of the left arm panel frame and the right arm panel frame includes:

a vertical front arm stump panel having an inwardly facing side and an outwardly facing side;

a vertical back arm stump panel having an inwardly facing side and outwardly facing side;

a top end and a bottom member disposed between the front arm stump panel inwardly facing side and the back arm stump panel inwardly facing side; and an inner panel affixed between the inwardly facing side of the front arm stump panel and the inwardly facing side of the back arm stump, wherein a plurality of wooden slats are disposed and affixed between the inwardly facing side top end of the front arm stump panel and the inwardly facing side top end of the back arm stump panel so that the wooden slats are spaced apart and follow a profile of the top end of the front arm stump panel and the top end of the back arm stump panel, the arm panel frame further comprising a horizontal wood slat affixed between the inwardly facing side of the front arm stump panel at a terminus adjacent the top end and the inwardly facing side of the back arm stump panel at a terminus adjacent the top end;

a planar sheet of a flexible underlayment material, the flexible underlayment material having a first edge, a second edge, and a front edge, the first edge attached with a plurality of fasteners to the horizontal wood slat, the second edge attached with a plurality of fasteners to the inner panel, and the front edge of the flexible underlayment material positioned to extend past the outwardly facing side of the front arm stump panel; and a finishing material having a first edge, a second edge separated by a back edge and a front edge, the finishing material fixedly attached with a plurality of fasteners at the first edge and at the second edge to the arm panel frame bottom member, the back edge fixedly attached with a plurality of fasteners to the outwardly facing side of the back arm stump panel, and the front edge fixedly attached with a plurality of fasteners to the outwardly facing side of the front arm stump panel.

2. The upholstered sofa of claim 1, comprising a vertically oriented edge roll having a top end and a bottom end, the top end butted against the second edge of the flexible underlayment material and fixedly attached to the outwardly facing side of the front arm stump panel with a plurality of fasteners.

3. The upholstered sofa of claim 1, comprising a low melt fiber material disposed between the flexible underlayment material and the finishing material, the low melt fiber material being disposed on top of and contacting the flexible underlayment material, wherein the low melt fiber material has a first edge, a second edge, and a front edge, the second edge and the front edge both extending beyond the corresponding flexible underlayment material second edge and front edge, the low melt fiber material fixedly attached with a plurality of fasteners at the first edge to the horizontal wood slat and at the second edge to the inner panel, and the front edge fixedly attached with a plurality of fasteners to the outwardly facing side of the front arm stump panel.

4. The upholstered sofa of claim 1 wherein the flexible underlayment material has a thickness of about 0.5 to 1.5 cm.

5. The upholstered sofa of claim 1 wherein the flexible underlayment material has a density of 0.08 to 0.30 gms/$cm^3$.

6. The upholstered sofa of claim 1 wherein the box frame left side and box frame right side are comprised of the arm panel frame inner panels.

7. The upholstered sofa of claim 1, wherein the vertical front arm stump panel and the vertical back arm stump panel of the arm panel frame includes a top end having a curvature extending at least 200 degrees and a downward face.

8. The upholstered sofa of claim 7, wherein the curvature extends at least 270 degrees.

9. The upholstered sofa of claim 1, wherein the wood slats include rectangular cross-sections.

10. The upholstered sofa of claim 1, wherein the seat base includes an upright back rest portion attached to the seat base, and a right arm panel frame and a left arm panel frame attached to the seat base and back rest portion wherein the seat base and back rest are disposed between the right arm panel frame and the left arm panel frame, wherein the seat base has a rectangular shape and forms a box frame having a left side, a right side, a front side, and a back side defining an open interior space, wherein the back rest portion is affixed to the back side of the seat base and between the right arm panel frame and the left arm panel frame so that the back rest portion is in an upright position.

11. A method of assembling an upholstered sofa comprising:

receiving a sofa frame having a rectangular seat base with an upright back rest portion integral with the seat base, and a right arm panel frame and a left arm panel frame integral with the seat base and back rest portion wherein the seat base and back rest are disposed between the right arm panel frame and the left arm panel frame, wherein the seat base has a rectangular shape and forms a box frame having a left side, a right side, a front side, and a back side defining an open interior space, wherein the back rest portion is affixed to the back side of the seat base and between the right arm panel frame and the left arm panel frame so that the back rest portion is in an upright position, wherein the arm panel frames each comprise a vertical front arm stump panel having an inwardly facing side, an outwardly facing side, and a top end having a curvature extending at least 180 degrees and a downward face, the arm panel frame further comprising a vertical back arm stump panel having and inwardly facing side, an outwardly facing side, and a top end having a curvature extending at least 180 degrees and a downward face, the arm panel frame further comprising a bottom member integral with and disposed between the front arm stump panel inwardly facing side and the back arm stump panel inwardly facing side, wherein a plurality of wooden slats, having rectangular cross-sections, are disposed and integrally affixed between the inwardly facing side top end of the front arm stump panel and the inwardly facing side top end of the back arm stump panel so that the wooden slats are spaced apart and follow the curvature of the top end of the front arm stump panel and the top end of the back arm stump panel, the arm panel frame further comprising a horizontal wood slat, with a rectangular cross-section, integrally affixed between the inwardly facing side of the front arm stump panel at a terminus adjacent the downward face of the top end and the inwardly facing side of the back arm stump panel at a terminus adjacent the downward face of the top end, and the arm panel frame further comprising an inner panel integral with and affixed between the inwardly facing side of the front arm stump panel and the inwardly facing side of the back arm stump panel opposite the attachment member;

receiving a planar sheet of a flexible underlayment material, the flexible underlayment material having a first edge, a second edge, and a front edge, attaching the first edge with a plurality of fasteners to the horizontal wood slat, attaching the second edge with a plurality of fasteners to the inner panel, and positioning the front edge of the flexible underlayment material to extend past the outwardly facing side of the front arm stump panel by about 0.25 inches to about 0.5 inches;

receiving a vertically oriented edge roll having a top end and a bottom end, butting the top end against the flexible underlayment material second edge and fixedly attaching the edge roll to the outwardly facing side of the front arm stump panel with a plurality of fasteners;

receiving a low melt fiber material and positioning the low melt fiber material on top of and contacting the flexible underlayment material wherein the low melt fiber material has a first edge, a second edge, and a front edge, extending both the second edge and the front edge beyond the corresponding flexible underlayment material second edge and front edge, fixedly attaching the low melt fiber material with a plurality of fasteners at the first edge to the horizontal wood slat and at the second edge to the inner panel, and fixedly attaching the front edge with a plurality of fasteners to the outwardly facing side of the front arm stump panel; and receiving a finishing material and positioning the finishing material on top of and contacting the low melt fiber material wherein the finishing material has a first edge, a second edge, a back edge, and a front edge, extending the edges beyond the corresponding low melt fiber material edges, fixedly attaching the finishing material with a plurality of fasteners at the first edge and at the second edge to the arm panel frame bottom member, fixedly attaching the back edge with a plurality of fasteners to the outwardly facing side of the back arm stump panel, and fixedly attaching the front edge with a plurality of fasteners to the outwardly facing side of the front arm stump panel.

12. The method of claim 11 wherein the flexible underlayment material has a thickness of about 0.5 to 1.5 cm.

13. The method of claim 11 wherein the flexible underlayment material has a density of about 0.21 gms/cm$^3$.

14. The method of claim 11 wherein the box frame left side and box frame right side are comprised of the arm panel frame inner panels.

15. An upholstered sofa comprising:

a sofa frame having a rectangular seat base and a right arm panel frame and a left arm panel frame integral with the seat base and a back rest portion wherein the seat base and back rest are disposed between the right arm panel frame and the left arm panel frame, wherein the arm panel frames each comprise a vertical front arm stump panel having an inwardly facing side, an outwardly facing side, and a top end having a curvature extending at least 200 degrees and a downward face, the arm panel frame further comprising a vertical back arm stump panel having and inwardly facing side, an outwardly facing side, and a top end having a curvature extending at least 200 degrees and a downward face, a plurality of wooden slats, having rectangular cross-sections, are disposed and integrally affixed between the inwardly facing side top end of the front arm stump panel and the inwardly facing side top end of the back arm stump panel so that the wooden slats are spaced apart and follow the curvature of the top end of the front arm stump panel and the top end of the back arm stump panel;

a planar sheet of a flexible underlayment material having a first edge, a second edge, and a front edge, the first edge attached with a plurality of fasteners to the horizontal wood slat, the second edge attached with a plurality of fasteners to the inner panel, and the front edge of the flexible underlayment material positioned to extend past the outwardly facing side of the front arm stump panel by about 0.25 inches to about 1.00 inches;

a cushion material positioned on top of and contacting the flexible underlayment material wherein the cushion material has a first edge, a second edge, and a front edge, the second edge and the front edge both extending beyond the corresponding flexible underlayment material second edge and front edge, the cushion material fixedly attached with a plurality of fasteners at the first edge to the horizontal wood slat and at the second edge to the inner panel, and the front edge fixedly attached with a plurality of fasteners to the outwardly facing side of the front arm stump panel; and a finishing upholstering material positioned on top of and contacting the cushion material wherein the finishing material has a first edge, a second edge, a back edge, and a front edge, the edges extending beyond the corresponding edges of the cushion material, the finishing material fixedly attached with a plurality of fasteners at the first edge and at the second edge to the arm panel frame, the back edge fixedly attached with a plurality of fasteners to the outwardly facing side of the back arm stump panel, and the front edge fixedly attached with a plurality of fasteners to the outwardly facing side of the front arm stump panel.

16. The upholstered sofa of claim 15 wherein the flexible underlayment material has a density of 0.21 gms/cm$^3$.

17. An arm rest panel, comprising:

an arm panel frame including a front arm stump panel; and a planar sheet of a flexible material attached with a plurality of fasteners directly to arm panel frame without an underlayment layer interstitial therebetween, wherein a front edge of the planar sheet extends past an outwardly facing side of the front arm stump panel, wherein the arm panel frame includes:

a vertical front arm stump panel having an inwardly facing side and an outwardly facing side;

a vertical back arm stump panel having an inwardly facing side and outwardly facing side;

a top end and a bottom member disposed between the front arm stump panel inwardly facing side and the back arm stump panel inwardly facing side; and an inner panel affixed between the inwardly facing side of the front arm stump panel and the inwardly facing side of the back arm stump, wherein a plurality of wooden slats are disposed and affixed between the inwardly facing side top end of the front arm stump panel and the inwardly facing side top end of the back arm stump panel so that the wooden slats are spaced apart and follow a profile of the top end of the front arm stump panel and the top end of the back arm stump panel, the arm panel frame further comprising a horizontal wood slat affixed between the inwardly facing side of the front arm stump panel at a terminus adjacent the top end and the inwardly facing side of the back arm stump panel at a terminus adjacent the top end, wherein the planar sheet includes a first edge, a second edge, and a front edge, the first edge attached with a plurality of fasteners directly to the horizontal wood slat without an underlayment layer interstitial therebetween, the second edge attached with a plurality of fasteners directly to the inner panel without the underlayment layer interstitial therebetween.

18. The arm rest panel of claim 17, comprising a finishing material disposed directly on the planar sheet without a cushioning layer disposed between the finishing material and the planar sheet.

19. The arm rest panel of claim 17, comprising:

a low melt fiber material disposed directly on and in contact with the planar sheet; and a finishing material disposed directly on and in contact with the low melt fiber material.

20. The arm rest panel of claim 17, wherein the finishing material includes a first edge, a second edge separated by a back edge and a front edge, the finishing material fixedly attached with a plurality of fasteners at the first edge and at the second edge to the arm panel frame bottom member, the back edge fixedly attached with a plurality of fasteners to the outwardly facing side of the back arm stump panel, and the front edge fixedly attached with a plurality of fasteners to the outwardly facing side of the front arm stump panel.

21. The arm rest panel of claim 17, wherein the front edge of the planar sheet extending past the outwardly facing side of the front arm stump panel functions to eliminate installation of an edge roll on the outwardly facing side of the front arm stump panel.

* * * * *